United States Patent [19]

Huntzinger

[11] Patent Number: 4,761,642

[45] Date of Patent: Aug. 2, 1988

[54] SYSTEM FOR PROVIDING DATA COMMUNICATION BETWEEN A COMPUTER TERMINAL AND A PLURALITY OF CONCURRENT PROCESSES RUNNING ON A MULTIPLE PROCESS COMPUTER

[75] Inventor: Gregory G. Huntzinger, West Linn, Oreg.

[73] Assignee: Tektronix, Inc., Beaverton, Oreg.

[21] Appl. No.: 784,413

[22] Filed: Oct. 4, 1985

[51] Int. Cl.[4] ..... G09G 1/16

[52] U.S. Cl. ..... 340/721; 340/723; 340/747; 364/521

[58] Field of Search ..... 340/707, 721, 747, 724, 340/723, 750; 364/521

[56] References Cited

U.S. PATENT DOCUMENTS

| | | | |
|---|---|---|---|
| 3,898,643 | 8/1975 | Ettlinger | 340/707 |
| 4,258,361 | 3/1981 | Hydes et al. | 340/721 |
| 4,498,081 | 2/1985 | Fukushima et al. | 340/721 |
| 4,559,533 | 12/1985 | Bass et al. | 340/747 |
| 4,598,384 | 7/1986 | Shaw et al. | 340/721 |
| 4,618,859 | 10/1986 | Ikeda | 340/747 |
| 4,642,790 | 2/1987 | Minshull et al. | 340/747 |

*Primary Examiner*—Marshall M. Curtis

*Attorney, Agent, or Firm*—Daniel J. Bedell; Robert S. Hulse

[57] ABSTRACT

An apparatus for displaying the display outputs of a plurality of simultaneously active computer processes in corresponding windows on a single screen includes a microcomputer, a display screen and display system software. The software represents a plurality of virtual terminals, one corresponding to each active process, for emulating the operation of real terminals communicating with the processes. Each virtual terminal maintains a display list comprising a set of instructions defining a display on a screen according to the output from the corresponding process. The software also includes a screen process for maintaining a subrectangle list comprising a set of instructions for allocating window portions of the screen to the displays defined by the separate display lists. A display list processor is provided for creating the windows on the screen according to the display and subrectangle lists.

1 Claim, 5 Drawing Sheets

SYSTEM FOR PROVIDING DATA COMMUNICATION BETWEEN A COMPUTER TERMINAL AND A PLURALITY OF CONCURRENT PROCESSES RUNNING ON A MULTIPLE PROCESS COMPUTER

BACKGROUND OF THE INVENTION

The present invention relates in general to multiple process computer systems and more particularly to a method and apparatus for simultaneously displaying multiple process outputs on a single screen.

Typically operators access computers through terminals including an input device such as a keyboard and an output display device such as a cathode ray tube (CRT) screen. Although many types of terminals are available, terminals of the prior art provide for a single output stream directed from the computer to the operator and a single input stream from the operator to the computer. When the terminal accesses a multiprocess computer, only one computer process attaches its input and output to these streams and does not relinquish them to another computer process until it is suspended. At that time another computer process may attach its input and output to these streams.

Most operators would find it difficult to manage more than one input device simultaneously so the limitation that a terminal can handle only a single input stream is of little practical significance. However, operators can monitor more than one output stream and the limitation that the terminal can handle only one output stream is more serious. For instance, an operator in a power plant may wish to view the outputs of several programs running on a multi-process computer which monitors plant operation. If only one terminal is used, the operator could only view the program outputs in succession since only one program can output to the terminal at a time. The traditional alternative is to provide a separate terminal for each process output stream. This permits the display outputs of all of the processes to be updated continuously and simultaneously.

The use of multiple terminals is an expensive solution to the problem, in terms of space and money, and it is often inconvenient for the operator to simultaneously monitor several screens. A partial remedy to this problem found in the prior art involves the use of separate windows on a CRT screen to display the outputs of separate computer processes. But there are limitations to this solution as well. First, there is still only one output stream and therefore only one process can update its associated display window at a time. The other processes must wait until the process controlling the stream is finished with its current window update cycle and relinquishes the output stream. Therefore, while the outputs of several processes may be displayed on a single screen, only one such output can be active and a process which must send data to the terminal before it can continue is suspended until it acquires control of the output stream. Secondly, to provide for larger views, when given a limited screen size, the windows are typically overlapped with the active window on top. When a process takes over the stream, its window is placed on top while portions of other windows which are covered are lost. This problem has been remedied, in the case of a terminal using a frame buffer memory storing display control data, by moving the data representing obscured window portions from the frame buffer memory to a secondary storage memory so that the obscured portions of the windows can be restored when these windows are once again brought to the forefront. However, such movement of display data takes time, retarding the speed of screen update.

A third problem associated with existing window systems relates to the need to modify each application process so that it writes only to the window and not the entire screen. This makes it difficult to adapt preexisting software for use in conjunction with a windowed display system.

What is needed is a system whereby output streams from multiple, active, application processes can be directed from a computer to a single display screen for concurrent, active display without requiring modification to the application programs.

SUMMARY OF THE INVENTION

According to one aspect of the invention, a display system is provided for transmitting and receiving the input and output streams of each of a plurality of processes running on a multiple process, multiple user host computer. Each input stream carries input data from an operator to the process and each output stream carries screen update data from the process to the display system. The display system includes a microprocessor for running a multiple process display operating system. For each output stream, the display operating system creates an associated "virtual terminal" process for sending and receiving the input and output streams of the associated host computer process. Each virtual terminal is adapted to simulate the operation of a selected real terminal with respect to the transmission and receipt of input and output streams, except that each virtual terminal merely prepares and stores a set of instructions (a display list) for creating a full screen display according to the data from the associated process, but does not independently control a separate screen. The display lists maintained by each virtual terminal are sent to a common display list processor which creates a set of windows on a single screen, each window containing a display according to a separate one of the display lists. Thus a single terminal appears to the host computer to be a set of multiple terminals. Each host computer process has sole use of an input/output stream and it is not necessary to suspend one host computer process and activate another in order to provide shared access to a terminal.

According to another aspect of the invention, the display window associated with each host computer process may be created, deleted, moved, buried beneath another window, uncovered, collapsed or expanded according to commands from an operator. A screen process created by the display operating system monitors instructions from the operator regarding these window control operations and creates a "subrectangle list" indicating which windows are to be displayed along with the size of each window, the positioning of the window on the screen and the portions of which windows are to be obscured by overlapping windows. As new display lists are produced by each virtual terminal, they are provided to the display list processor which converts the display list data into display control data transmitted to a frame buffer that updates the display. The virtual terminal associated with each window updates, stores and transmits display lists to the display list processor each time it receives data from the host process, regardless of whether the window is currently displayed or whether some portion of the window is obscured. The display list processor uses the subrectangle list to determine what portions of each window are to be displayed, and uses the display lists to determine the nature of the display. Thus every displayed window is output active in the sense that it may be changed by the associated host computer process at any time regardless of the input/output operation of any other host computer process.

According to a further aspect of the invention, each time the operator makes a change in the way one or more windows are displayed, the screen process changes the subrectangle list and transmits a redraw command to each virtual terminal associated with a changed window. Each such virtual terminal retrieves its display lists from memory and transmits them to the display list processor which then modifies the screen according to the display and subrectangle lists. Thus it is not necessary for data to be moved from the frame buffer memory to a secondary memory in order to save screen control data corresponding to portions of a window obscured by another window or temporarily removed from view. Therefore, windows not currently displayed or only partially displayed are still output active in the sense that the display lists controlling the windows are independently updated whenever a host computer process transmits output data to its associated virtual terminal. Since the virtual terminals store these lists in memory, the lists are readily available to the display list processor whenever the operator chooses to display the associated window. Also, since each process in the host computer has exclusive access to a corresponding virtual terminal maintaining a display list including instructions for writing to an entire screen, it is not necessary to modify the process application so that the process writes only to a window portion of a screen.

According to still another aspect of the invention, while every window is simultaneously output active, only a single displayed window is input active in that data transmitted to the terminal from the operator using a keyboard or other input device is forwarded only to a virtual terminal associated with a single, selected window for further transmission to the associated host computer process. The display system is adapted to permit an operator to select the window to be input active by placing a cursor over the window and operating a pushbutton. This feature permits the operator to provide input data to any one of several concurrent host computer processes from a single terminal and to rapidly redirect input data to a different host computer process without suspending one process and activating another.

It is accordingly an object of the present invention to provide a new and improved method and apparatus for providing concurrently active output displays from multiple processes on a single screen.

It is another object of the invention to provide a new and improved method and apparatus for providing operator input to any selected one of a plurality of processes from a single input device.

It is a further object of the invention to provide a new and improved method and apparatus for displaying outputs of multiple processes in screen windows when the processes are adapted for writing to entire screens.

The subject matter of the present invention is particularly pointed out and distinctly claimed in the concluding portion of this specification. However, both the organization and method of operation of the invention, together with further advantages and objects thereof, may best be understood by reference to the following description taken in connection with accompanying drawings wherein like reference characters refer to like elements.

DRAWINGS

DETAILED DESCRIPTION

Figure 1:
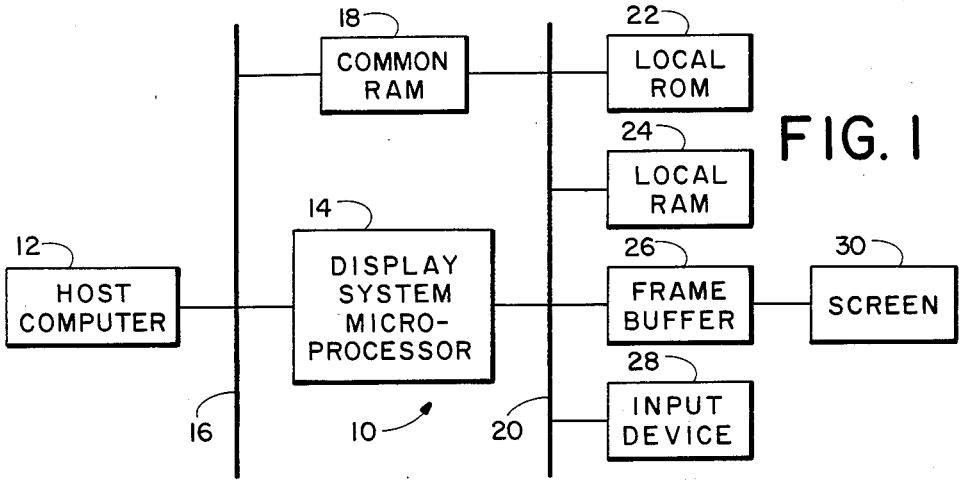
FIG. 1 is a hardware block diagram of a multiple process windowed display system of the present invention.

Referring to FIG. 1, there is depicted in block diagram form a display system 10 adapted to provide input and output access to a multiple process, multiple user host computer 12. The display system 10 comprises a display system microprocessor 14 connected to the host computer 12 by a common bus 16. The host computer 12 and the display system microprocessor 14 communicate with one another by reading and writing data to a common random access memory (RAM) 18. The system 10 also includes a local bus 20 providing communication between the microprocessor 14 and a local read only memory (ROM) 22, a local RAM 24, a frame buffer 26 and an operator input device 28 including a keyboard and a pushbutton mouse. Frame buffer 26 controls a display screen 30.

Host computer 12 suitably operates under the UNIX operating system which permits the computer to simultaneously run multiple independent processes and to provide input and output interface between each process and an associated terminal in a known fashion. System 10 is adapted to emulate the operation of a plurality of terminals, each independently managing input and output streams from a corresponding process running in host computer 12. The output of each process is selectively displayed in a corresponding window on screen 30, while operator input to each process is provided through a common input device, keyboard and mouse 28. Each window displayed on screen 30 is output active in that it may be changed according to data provided by the host computer process irrespective of the current input/output activity of any other process. However, only a selected one of the display windows is input active such that operator input from the keyboard or mouse 28 of input device is forwarded to only a single, selected host computer process at a time. The operator selects the window to be input active by using the mouse to move a cursor over the window and then pressing a first button on the mouse. Thereafter, all data from the input device 28 is forwarded to the associated host computer process until another window is selected.

Figure 2:
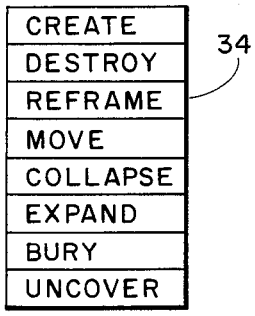
FIG. 2 is an illustration of a pop-up command menu which may be displayed by the terminal of FIG. 1.

The operator may create or destroy processes by creating or destroying windows, may hide a window from view, and may change the relative positions of windows on the screen, the size of the windows, and the order in which windows overlap. To do so, the operator places the cursor at a selected location on screen 30 and then presses and holds a second button on the mouse to cause a pop-up command window 34, depicted in FIG. 2, to be displayed on the screen at the selected location. The command window contains several boxes, each representing a separate command. The operator then moves the cursor to the selected command box and releases the button, causing the command window to disappear and the selected command to be executed. A "create" command permits the operator to create a window. A corner shaped cursor appears on the screen and the operator moves it to the position on the screen where the upper left hand corner of the new window is to be located and presses a mouse button. The operator then moves the cross hair cursor to a position on the screen where the lower right hand corner of the window is to be located and again presses the mouse button. The display system 10 then transmits information to the host computer operating system that a new process is requested and the host computer operating system creates the new process. Display system 10 creates a blank window on screen 32 at the corner coordinates defined by the operator and also creates a software-based "virtual terminal" to provide a point of interface between the new process and the terminal. The virtual terminal emulates the operation of a real terminal which the new process is capable of driving. The particular terminal to be emulated is determined by the operator's responses to prompts displayed on the screen following selection of the create command. Subsequent data transmitted from the new process to the new virtual terminal is used to control the display within the new window. Thus system 10 maintains a separate virtual terminal to service the input/output requirements of each independent process in the host computer 12 and each virtual terminal controls the display within a corresponding window on screen 30.

The operator can destroy a window by popping up the command window and selecting a "destroy" command. This command causes the virtual terminal associated with the host computer process to transmit a process termination message to the host computer and also causes system 10 to subsequently terminate the virtual terminal associated with the window and remove the window from the screen.

The operator can also select a "reframe" command from the command window permitting him to redefine the size and position of an existing window in the same way he defined the size and position of a new window. The reframed window is then displayed on the screen while the existing window is collapsed. A "move" command permits the operator to "drag" an existing window from one screen location to another by selecting the window with the cursor and moving the cursor to a new location before releasing a cursor button. A "bury" command permits an operator to place a selected screen "behind" another window in the manner that any overlapping portion of the selected window is obscured by the other window. An "uncover" command has the opposite effect, permitting the operator to select a window to be placed in front of an overlapping portion of any other windows. An "activate" command permits the operator to select a window to be input activated. This command has the same effect as directly selecting a window with the cursor and pressing an activate button on the mouse, as discussed hereinabove. A "collapse" command permits an operator to temporarily remove a selected window from display without destroying the associated process or virtual terminal. In such case the associated virtual terminal continues to receive, process and store display data from the host computer process but the window is not displayed. The display system 10 creates and displays a small icon representinq the collapsed window along one edge of the screen. An "expand" command on the command menu permits the operator to restore to the screen a window which has been removed by the collapse command by selecting the appropriate icon.

Figure 3:
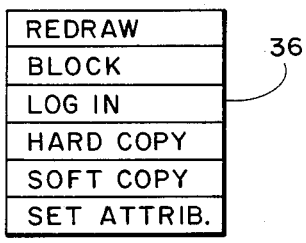
FIG. 3 is an illustration of a pop-up convenience menu which may be displayed by the terminal of FIG. 1.

Using another button on the mouse, the operator may call another pop-up window, the convenience window 36 illustrated in FIG. 3 which permits the operator to select additional commands. A "redraw" command causes the terminal to display all windows, including those previously collapsed. A "block" command permits the operator to prevent the terminal from updating the display of any window until a password is typed into the terminal using the keyboard. A "log in" command causes the terminal to display a "log in" pop-up window. Display system 10 creates the log in window, along with an associated virtual terminal, when system 10 is booted to provide the operator with access to the host computer operating system for logging into and out of the host generating system. The log in window can be collapsed like any other window but cannot be destroyed. "Hardcopy" and "softcopy" commands on the convenience menu permit the operator to send the current state of a selected window to a printer or to a disk file. A "set attribute" command permits the operator to set or change various display attributes of a selected window such as background and foreground colors, font style and the like by answering screen prompts with the keyboard.

Figure 4:
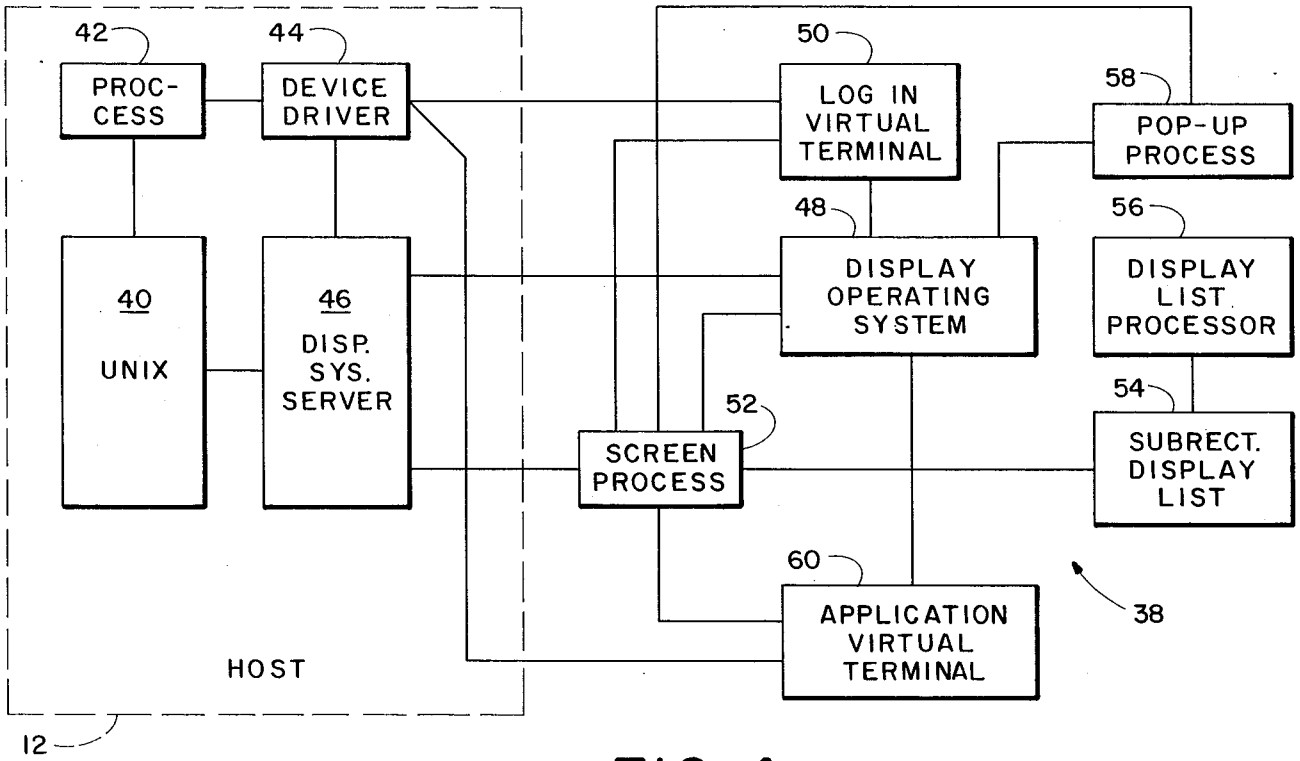
FIG. 4 is a software block diagram of the multiple process, windowed display system of the present invention.

Referring to FIG. 4, there is depicted a software block diagram of the multiple process windowed display system 38 of the present invention, along with a software block diagram of the host computer 12 served by the display system. The host computer 12 of FIG. 1 suitably operates under the UNIX operating system 40 adapted to simultaneously execute several applications programs by setting up separate processes 42 for each program. A device driver 44 manages input and output data streams between each process and an associated external terminal. A display system server 46 controls the routing and formatting of these input and output data streams between the device driver and the terminals.

The display system 38 includes a display operating system 48 to control the operation of microprocessor 14 of FIG. 1. When the system 10 is booted, the display operating system 48 is loaded into memory and implemented by microprocessor 14. The display operating system 48 is also a multiple process operating system and it initially creates a log in virtual terminal process 50 to communicate with the UNIX operating system 40, sending data to the display system server 46 indicating the nature of the terminal emulated by the virtual terminal and the software I/O socket at which it is located. The display system server then provides the appropriate data to device driver 44 to establish a communication path between the UNIX operating system 40 and the virtual terminal 50.

Also following display system boot, the display operating system 48 establishes a screen control process 52 which controls the display of windows on the screen by maintaining a "subrectangle display list" 54 stored in memory. The subrectangle display list 54 is a set of instructions which indicate which windows are to be displayed, the size, shape and location of each window, and the relative foreground/background positions of overlapping windows. Initially, the screen process 52 adjusts the subrectangle list so that only the log in window is displayed. The contents of the log in window are controlled by "display lists" generated by the log in virtual terminal 50 in response to information transmitted to it from the UNIX operating system via device driver 44. The display lists generated by the virtual terminal are transmitted to a display list processor 56 which generates display control data for storage in the frame buffer 26 of FIG. 1. The display list processor 56 determines which windows are to be displayed, along with their size, shape and screen locations from the information contained in the subrectangle display list 54 maintained by the screen process and determines what is to appear in each displayed window or window portion from display lists maintained by the associated virtual terminal.

Each window can display either text or graphics superimposed on one another to produce the window image. When the log in virtual terminal 50 receives data from the UNIX system 40 indicating that a log in prompt is to be displayed in the log in window, it sends three display lists to the display list processor 56. The first display list tells the display list processor 56 to make the window blank by clearing both surfaces. The second display list indicates the text to be displayed and the third display list tells the list processor the graphics to be displayed. Typically, for the log in window no graphics are displayed. Since the screen process 52 has initially set the subrectangle display list 54 to indicate that the entire log in window is to be displayed, the display list processor creates and fills the entire window.

The operator selects the log in window by moving the cursor into the window and pressing a button on the mouse. The display operating system senses this action and subsequently transmits any input from the keyboard to the log in virtual terminal. As the operator enters the log in information, the data is transmitted to the log in virtual terminal 50 which prepares new display lists which blanks the text screen in the window and then writes in the log in characters typed by the operator. The virtual terminal 50 also transmits the log in information to the UNIX system which creates a new shell process for the user.

At this point the operator may collapse the log in window. To do so the operator selects the command pop-up window as described hereinabove. Pop-up windows are controlled by a pop-up process 58, also established by the display operating system during the booting operation. When the operator selects the pop-up window, the display operating system sends the X,Y coordinates of the cursor, and a signal indicating the operator has depressed the appropriate mouse button, to the screen process 52. The screen process 52 then modifies the subrectangle display list 54 to tell the display list processor 56 to display the pop-up menu window in the location indicated by the X,Y coordinates of the cursor. The screen process 52 also transmits a redraw command to the pop-up process 58 telling it to transmit the appropriate display lists to the display list processor 56. The pop-up process 58 acquires the display lists associated with either the command or convenience windows from memory, the lists having been created during system boot. When the command window is displayed, and the operator selects a command, the display operating system 48 again sends the X,Y coordinates of the cursor to the screen process 52 which determines therefrom which command was selected. The screen process 52 then sends a message to the pop-up process 58 indicating the command selected and also modifies the subrectangle display list 54 so that the display list processor 56 collapses the command window. When the pop-up process 58 receives the command indication from the screen process, it calls a subroutine which performs the command.

As described hereinabove, the operator can initiate a new UNIX process by selecting the create command in the pop-up window. Each time the create command is selected, the display operating system 48 creates a new application virtual terminal 60 process. Although only one application virtual terminal 60 is shown in FIG. 4, one such virtual terminal 60 is created for each active process. The screen process 52 modifies the subrectangle display list 54 to establish the presence of the window and also transmits information to the display system server 46 to request a new process and to inform the server of the I/O socket through which the new virtual terminal may be accessed. The server 46 then requests the UNIX operation system to fork a new process for the user and establishes the path connecting the device driver 44 to the virtual terminal 60.

Whenever a window displayed on the screen is created, destroyed, collapsed, moved or resized, the screen process 52 alters the subrectangle list to effectuate the change in that window. It also alters the subrectangle list to change any other window affected by the change. For instance, when a new window is created, it may cover portions of other windows. Therefore the screen process alters the subrectangle list 54 so that the display list processor 56 knows to display only the portions of those windows not covered by the new window. The screen process 52 also sends a redraw command to every virtual terminal whose window display is affected by the new window, telling each such virtual terminal to transmit new display lists to the display list processor 56 so that the display list processor will know what to put in the displayed portions the windows. Whenever a virtual terminal modifies a display list in response to data from the associated UNIX process, it not only transmits the new display lists to the display list processor 56, it also maintains the display lists in memory so that it can retransmit them to the display list processor when it receives a redraw command from the screen process 52.

The display system 10 of the present invention, as depicted in FIG. 4, thus permits a plurality of independent processes, running in a multiprocess host computer 12, to independently control windows on the same screen. Each virtual terminal 50 or 60 remains available to receive display data from the associated process regardless of the state of operation of any other process. The display list processor 56 is adapted to update the windows as fast as the independently operating virtual terminals can produce revised display lists. From the operator's viewpoint each window is active and many windows may appear to change simultaneously. There is no need for the operator to terminate one process in order to input or output access another process. Also, since each virtual terminal stores the updated display lists, there is no need to transfer display data from the frame buffer to another memory when a portion of a window is covered, or when a window is collapsed because the window display can be restored by recalling the display list. Finally, a process may remain output active even if its corresponding window is not displayed since it is only necessary that the associated virtual terminal 60 update and store the associated display list. Thus the output stream from each host computer process is maintained regardless of the state of the display.

Figure 5:
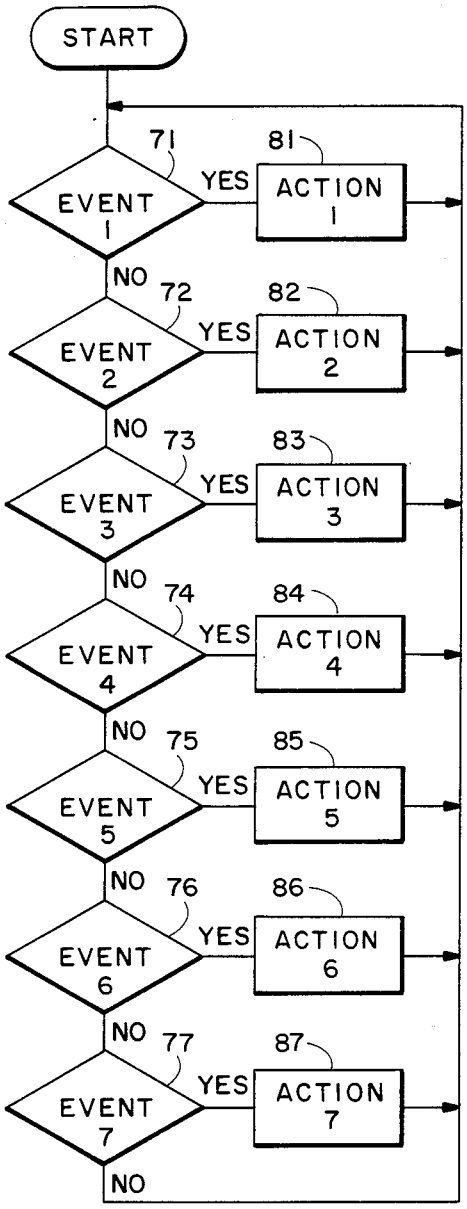
FIG. 5 is a flow chart of a software state machine for controlling the virtual terminal and screen processes of FIG. 2.

The virtual terminals 50 and 60, the pop-up process 58 and the screen process 52 are controlled by software based state machines as illustrated by a flowchart depicted in FIG. 5. The state machines can accept and respond to up to seven input event signals, numbered 1 to 7. The state machines start in block 70 when the process is initialized. Thereafter the process moves to block 71. If a signal indicates that an event 1 has not occurred block 71 directs flow to block 72. If an event 2 has not occurred, block 72 directs the program to block 73. In a similar fashion, decision blocks 73–77 check to see if events 3–7, respectively, have occurred and if not, program flow is directed to the next decision block. If none of the events have occurred, block 77 returns operation to block 71. Whenever a decision block 71–77 detects that the corresponding event has occurred, then blocks 71–77 direct flow to corresponding action blocks 81–87, respectively. Each action block 81–87 calls a corresponding subroutine labeled action 1–7. The subroutine performs a selected action and then returns to block 71. Thus it is seen that actions 1–7 are taken in response to events 1–7, and when an action is completed the process always returns to block 71. This arrangement gives action 1 the highest priority and action 7 the lowest priority.

The event 1 input for each virtual terminal state machine is a termination signal from the display operating system indicating that the UNIX process being served by the virtual terminal is to be terminated. Action 1 therefore comprises the steps of freeing the portion of memory currently used by the virtual terminal for storing its display lists, sending a process termination message to the UNIX system and then returning an acknowledgment to the display operating system so that the operating system can destroy the virtual terminal. Event 2 for each virtual terminal is the redraw request from the screen process. In action 2 the virtual terminal performs the following steps:

1. Build a clear screen display list;
2. Submit the clear screen display list to the display list processor;
3. Wait for a display change completion message from the display list processor;
4. Build a graphics display list from data in memory;
5. Submit the graphics display list to the display list processor;
6. Wait for another completion message from the display list processor;
7. Build a text display list from data in memory;
8. Submit the text display list to the display list processor;
9. Wait for another completion message from the display list processor;
10. Return a completion message to the screen process; and
11. Exit.

The virtual terminal state machine recognizes no event 3. Event 4 is the completion message from the display processor. Action 2 is actually suspended in steps 3, 6 and 9 and the program continues to cycle through blocks 71–77 until the completion message from the display process diverts the procedure to block 85 which simply sets a redraw flag and exits. On the next pass through block 73 the program is diverted again to block 83 where action 3 is resumed.

Event 5 is a message from the device driver indicating that it wants to send data to the virtual terminal. Action 5 comprises the following steps:

1. Receive the data from the display driver and acknowledge receipt;
2. Parse the data;
3. Build a clear screen display list;
4. Submit the clear screen display list to the display processor;
5. Wait for a completion message from the display list processor;
6. Build a graphics display list from data in memory and from the UNIX process;
7. Submit the graphics display list to the display list processor;
8. Wait for another completion message from the display list processor;
9. Build a text display list from data in memory and from the UNIX process;
10. Submit the text display list to the display list processor;
11. Wait for another completion message from the display list processor; and
12. Exit.

Event 6 is an acknowledgment signal from the device driver indicating that the UNIX process has received a data packet from the virtual terminal. In action 6 the virtual terminal destroys the data packet. Event 7 is a signal from the display operating system indicating that the virtual terminal is to receive keyboard input. In action 7 the virtual terminal acquires the keyboard data, builds a data packet for transmission to the device driver, and sends the data packet to the device driver. The virtual terminal retains a copy of the data packet until it receives the acknowledgment of receipt from the device driver (event 6).

For the screen process there are no events or actions 1 or 5. Screen process event 2 is an acknowledgement from the display system server that the UNIX operating system has established a new shell for the user. In action 2, the screen process modifies the subrectangle list so that the log in window is displayed. Screen process event 3 is the acknowledgment received from a virtual terminal after the terminal has responded to a redraw command. In action 3 the screen process sends the acknowledgment to a subroutine waiting for it. Event 4 is a signal from the display list processor indicating that it has processed a background display list which controls the screen background. This background display list is maintained by the screen process and is sent to the display list processor on system start up and whenever the operator makes a change to the background color using the attribute command in the convenience menu. In action 4 the screen process forwards the acknowledgment to the subroutine. Event 6 is a request from the display operating system to create a new shell. This occurs on system boot. In action 6, the screen process transmits the new shell message to the display system server.

Figure 6:
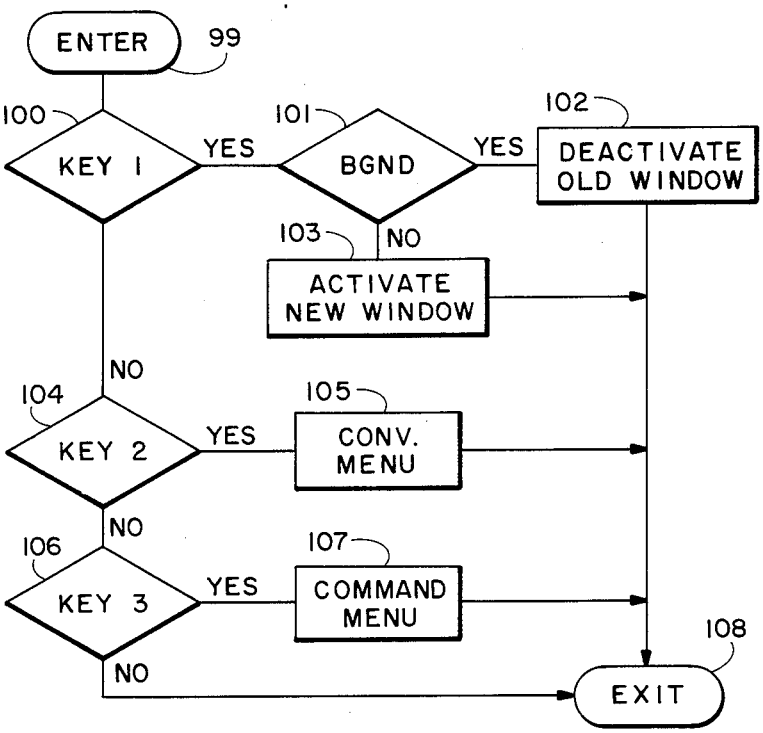
FIG. 6 is a flow chart of software implementing a portion of the screen process of FIG. 2.

Event 7 is an indication from the display operating system that the operator has moved the mouse out of the current input active window and has pressed a button. As long as the mouse is within the current input active window, the mouse input is sent to the virtual terminal behind the window and the screen process is not informed of mouse activity. Action 7 of FIG. 5 is illustrated by the flowchart of FIG. 6. Starting in block 99, the program proceeds to block 100 which passes program flow to block 101 if the first mouse key was depressed. If the cursor is over background space and not over a window or an icon, then the process moves to block 102 wherein the current input active window is input deactivated. Action 7 is then completed in block 108. If the cursor is over a window or over a collapsed window icon, block 101 directs flow to block 103 where the current input active window is input deactivated and the selected window is input activated. The action is then terminated in block 108.

If the second mouse key was depressed, the program passes from block 100 through block 104 to block 105 where a convenience menu subroutine is called and executed. If the third mouse button key was pressed, the program proceeds from block 100 through blocks 104 and 106 to a block 107 where a command menu subroutine is called and excited. If no key was pressed, or on completion of blocks 105 and 107, action 7 ends in block 108.

Figure 7:
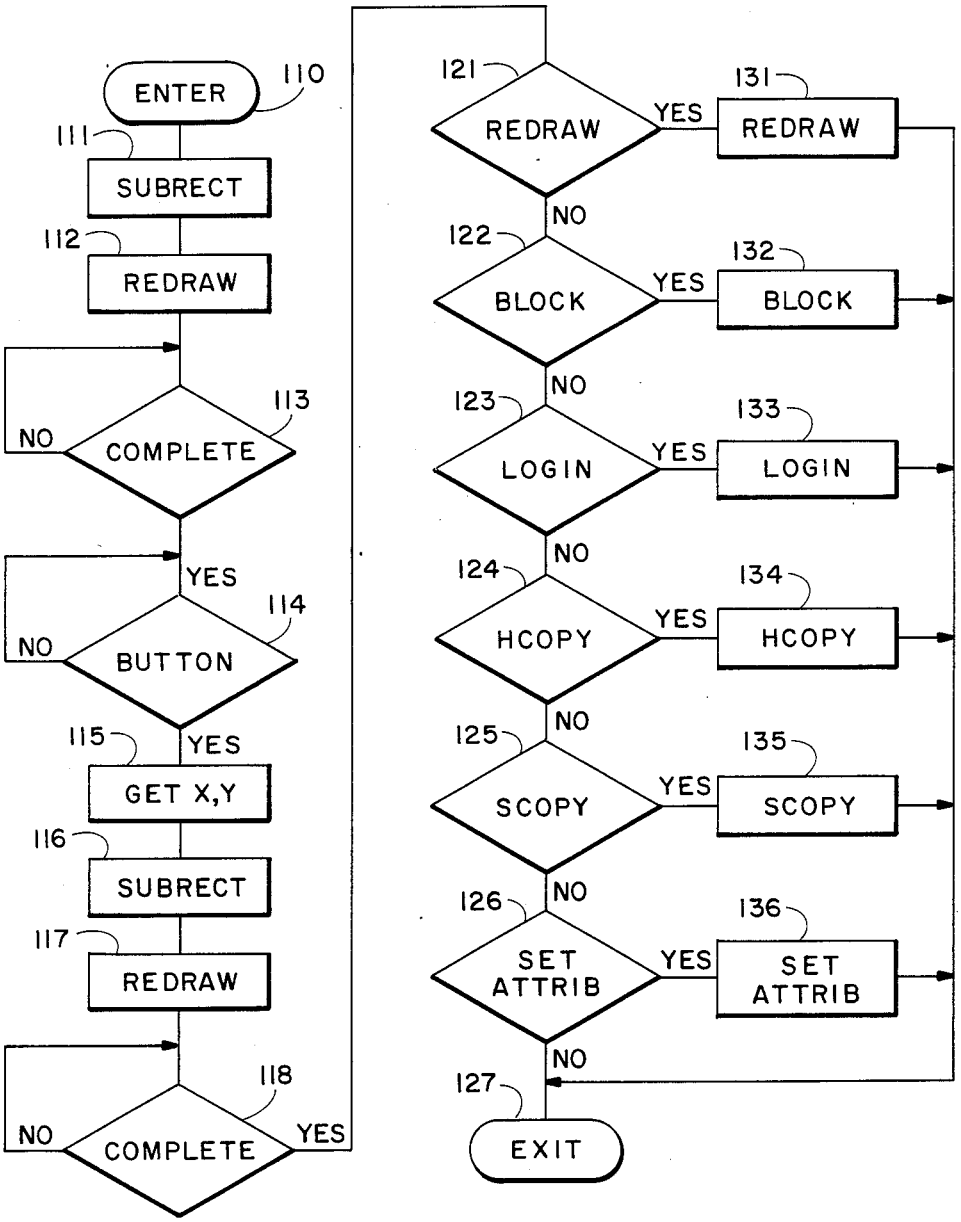
FIG. 7 is a more detailed flow chart of software implementing a block of the flow chart of FIG. 6.

FIG. 7 is a flowchart detailing the convenience menu subroutine of block 105. Starting in block 110, the subroutine modifies the subrectangle list so that the display list processor can display the convenience window. Then in block 112 the screen process transmits a redraw signal to the pop-up process indicating that it should transmit the display list for the convenience window to the display list processor. The screen process also transmits the redraw command to each virtual terminal controlling a window covered by the convenience window so that these terminals also transmit new display lists to the display list process. Then in block 113 the screen process waits for the display process completion signals from the pop-up process and each affected virtual terminal. On receipt of all completion signals, then, in block 114, the screen process waits until it receives a message from the display operating system that the operator has released the selection button. In block 115 the screen process acquires the X,Y coordinates of the mouse, at the time the mouse button is released, from the display operating system and determines what command was selected. Then in block 116, the screen process again modifies the subrectangle list to collapse the convenience wihdow, and, in block 117, transmits the redraw signal to all virtual terminals corresponding to windows uncovered when the command window collapses. In block 118 the screen process waits until it receives the display process completion messages from each affected virtual terminal.

Next, decision blocks 121–126, connected in sequence, divert the program to action blocks 131–136 respectively, if the operator has selected the redraw, block, log in, hardcopy, softcopy or set attribute commands. If no command is selected, or on completion of any action block 131–136, the subroutine ends in block 127. In block 131 the screen process changes the subrectangle list so that every window is expanded and sends a redraw command to each virtual terminal so that the screen is completely redrawn. In block 132, the screen process acquires a code message from the operator and then notifies the display operating system that the display list outputs of the virtual terminals to the display list processor are to be inhibited until further notice. If such output was already inhibited, the block command causes the screen process to wait for the same code message from the operator and then to send a message to the operating system unblocking the screen. (The operator can then update the screen using the redraw command discussed hereinabove.) In block 133, the screen process requests the display server to initiate the new UNIX shell, permitting the operator to log in. In blocks 134 and 135, the screen process sends a message to the operating system requesting that the current screen should be printed or saved in memory. In block 136 the screen process modifies the subrectangle list to reflect changes in display attributes keyed in by the operator.

Figure 8:
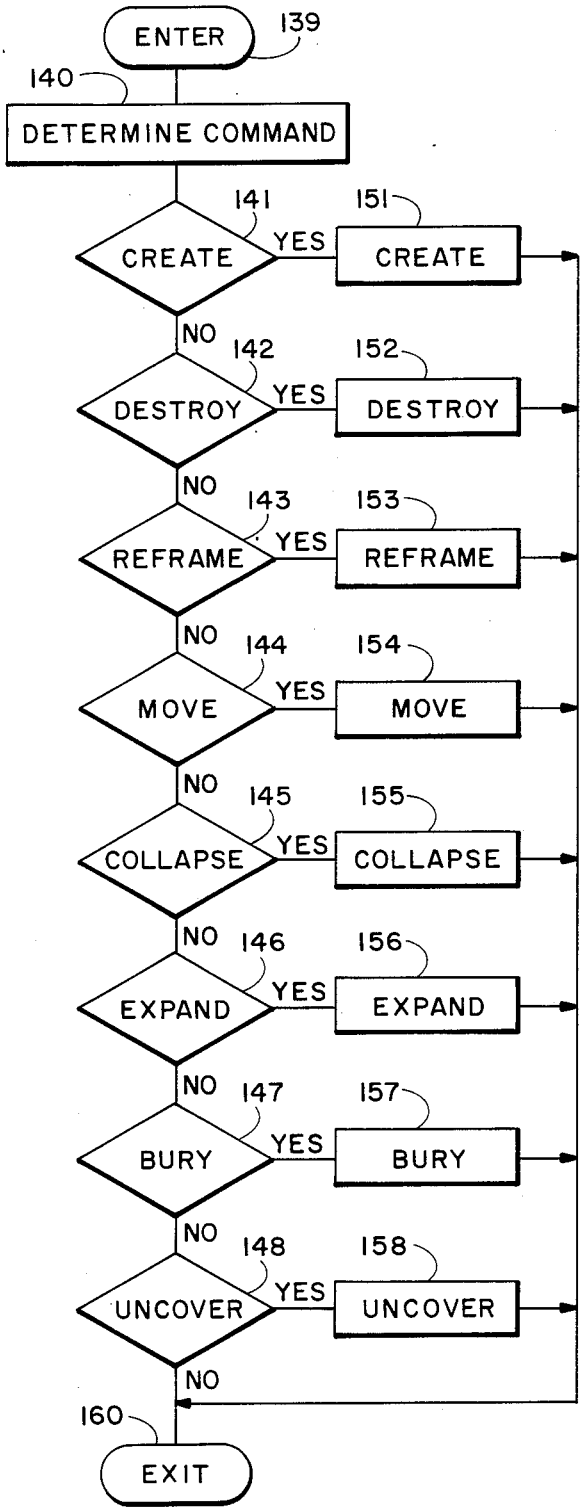
FIG. 8 is a more detailed flow chart of software implementing another block of the flow chart of FIG. 6.

The detailed operation of action block 107 of FIG. 6 is flowcharted in FIG. 8. The action begins in block 139, and in block 140 the screen process determines the command selected by the operator. Block 140 includes steps substantially the same as blocks 111 to 118 of FIG. 7. Next, in decision blocks 141–148, connected in sequence, program flow is diverted to blocks 151–158, respectively, if the the operator has selected the create, destroy, reframe, move, collapse, expand, bury or uncover commands. If none of these commands were selected, the action terminates in block 160. Once any action block 151–158 is completed, program flow also returns to block 160.

If the create command was selected, then in block 151, the screen process creates a new window, first by acquiring the X,Y coordinates of the upper left hand and lower right hand window corners transmitted from the display operating system in response to mouse push-button operation. The screen process then sends a message to the display system server requesting a new UNIX process, and waits for a reply from the display system server. When the server replies, the screen process requests the display operating system to create a new virtual terminal. The screen process then modifies the subrectangle list, sends a redraw command to all affected virtual terminals, and waits for a reply before completing the action block.

When the operator selects the destroy command, program flow is directed to block 152 wherein the screen process modifies the subrectangle list to eliminate the window to be destroyed and sends a terminate message to the corresponding virtual terminal. It also sends a draw message to any virtual terminal controlling a window being uncovered. If the reframe command is selected, then in block 153 the screen process acquires the upper left hand and lower right hand window coordinates from the display operating system in response to cursor movement and mouse button operation, changes the subrectangle list and sends a redraw message to all affected windows.

If the move command was selected, then in block 154 the screen process acquires the new screen X,Y coordinates for the upper left hand corner of the window being moved, changes the subrectangle list to effectuate the mouse, and sends a redraw message to the virtual terminals behind all affected windows. If the collapse command is selected, then in block 155 the screen process changes the subrectangle list to remove the window and sends a redraw command to the virtual terminals controlling every uncovered window. If the expand command is selected, then in block 156 the subrectangle list is modified so that the selected window is displayed and a redraw message is sent to its virtual terminal and to all other virtual terminals behind windows being covered by the expanded window. If the bury command is selected, then in block 157 the screen process changes the subrectangle list to put the window behind any overlapping windows and sends the redraw command to all affected virtual terminals. Finally, if the uncover command is selected, the screen process changes the subrectangle list to put the selected window on top of all overlapping windows and sends the redraw command to each affected virtual terminal.

Thus the display system of the present invention permits multiple active processes to simultaneously display and update their outputs on a single screen and permits an operator to quickly input access any one of the processes at any time. Further, the window operations performed by the system are transparent to the host process applications since each application is permitted independent access to its own virtual terminal.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. In a computer system having a memory and having processing means for concurrently executing multiple processes, including first processes, each of which first processes receives input data produced by a computer terminal of said computer system and produces output data for controlling display on a screen of said computer terminal, a method for permitting concurrent data communication between a plurality of said first processes and a single computer terminal, the method comprising the steps of:

initiating and concurrently executing for each of said first processes a corresponding virtual terminal process each virtual terminal process receiving input data from the single computer terminal and forwarding said input data to the corresponding first process, receiving output data produced by the corresponding first process, and maintaining a separate display list in said memory, said display list comprising data defining a display in accordance with said output data produced by the corresponding first process;

initiating and executing a screen process for maintaining a subrectangle list in said memory, said subrectangle list comprising a set of instructions defining positions and sizes of display windows to be displayed on a screen of said single computer terminal, each window corresponding with a separate display list; and initiating and executing a display list process for periodically transmitting display data to said single computer terminal for causing said single computer terminal to concurrently display said display windows on said screen at positions and of sizes defined by said subrectangle list, each window including a display in accordance with the display defined by the corresponding subrectangle list.

* * * * *